US005125570A

United States Patent [19]

Jones

[11] Patent Number: 5,125,570

[45] Date of Patent: Jun. 30, 1992

[54] DELIVERY BOX SIGNAL DEVICE

[76] Inventor: Robert Jones, 4353 Sampson Rd., Youngstown

[21] Appl. No.: 814,484

[22] Filed: Dec. 30, 1991

[51] Int. Cl.[5] ..... B65D 91/00

[52] U.S. Cl. ..... 232/34; 232/1 C

[58] Field of Search ..... 232/1 C, 17, 34, 35

[56] References Cited

U.S. PATENT DOCUMENTS

| | | | |
|---|---|---|---|
| 815,585 | 3/1906 | Farrar | 232/35 |
| 1,123,647 | 1/1915 | Ackman | 232/34 |
| 1,307,242 | 6/1919 | Courtney | 232/34 |
| 1,315,914 | 9/1919 | Dubbs | 232/34 |
| 1,334,106 | 3/1920 | Mackey . | |
| 1,929,734 | 10/1933 | Evans | 232/17 |
| 2,496,962 | 2/1950 | Shaw | 232/1 C |
| 2,819,139 | 1/1958 | Stevenson | 232/34 |
| 3,033,443 | 5/1962 | Barnes | 232/34 |
| 3,166,241 | 1/1965 | Leutheuser . | |
| 3,275,228 | 9/1966 | Golla . | |
| 4,089,460 | 5/1978 | Mellard . | |
| 4,651,135 | 3/1987 | Duhaime et al. | 232/34 |
| 4,995,330 | 2/1991 | Likens | 232/34 |

*Primary Examiner*—Renee S. Luebke
*Assistant Examiner*—Michael J. Milano
*Attorney, Agent, or Firm*—Harpman & Harpman

[57] ABSTRACT

A delivery box signal for use on mail and newspaper delivery boxes and the like. The spring urged pivoted platform within the box engages a control activation rod alternately displaying a signal bell within a directional viewing port extending below the delivery box.

6 Claims, 2 Drawing Sheets

DELIVERY BOX SIGNAL DEVICE

BACKGROUND OF THE INVENTION

1. Technical Field

This invention relates to mail box and newspaper signaling devices that are used to indicate when delivery takes place. They are activated by placement of the material within the box indicating to the owner the presence of delivered material within.

2. Description of Prior Art

Prior art devices of this type have relied on a variety of different structural arrangements that respond by the insertion of material within the box, see for example U.S. Pat. Nos. 1,307,242, 1,354,106, 3,166,241, 3,275,288 and 4,089,460.

In U.S. Patent No. 1,307,242 a mail box is disclosed having a off centered pivoted platform that tips forward when mail is placed thereon raising the indicator flag extending out of the top of the box.

U.S. Pat. No. 3,334,106 is drawn towards a mail box signal having a centralized pivot disk with a signal flag attached thereto. A movable bottom is pivoted at one end so that upon receipt of mail the bottom will drop, rotating the disk and thus raising the signal flag.

U.S. Pat. No. 3,166,241 has a hinged mail support plate engaged at one end over a crank with a flag attached thereto. Upon activation of the device the supporting plate drives the crank, lowering the flag.

In U.S. Pat. No. 3,275,228 an automatic signalling delivery box can be having a one-piece resilient spring member secured at one end within the box with the opposite free end extending outwardly therefrom. A reflector is mounted on the free end which becomes visible upon activation below the box.

Finally, in U.S. Pat. No. 4,089,460 a device is drawn towards a signalling mechanism having a counter balance weighted mail receiving platform using movable weights within. Mail deposited within the box on the platform offsets the pre-balanced mechanism activating a signalling arm extending upwardly along the back wall of the box.

SUMMARY OF THE INVENTION

A delivery box signaling device for use within existing mail and newspaper boxes utilizes a spring loaded armature to reposition a signal bell within a directional viewing housing extending below said box. The viewing housing is adjustable to selectively aim a viewing port in the desired direction independently of the signal activation and movement within.

DESCRIPTION OF THE PREFERRED EMBODIMENT

Figure 1:
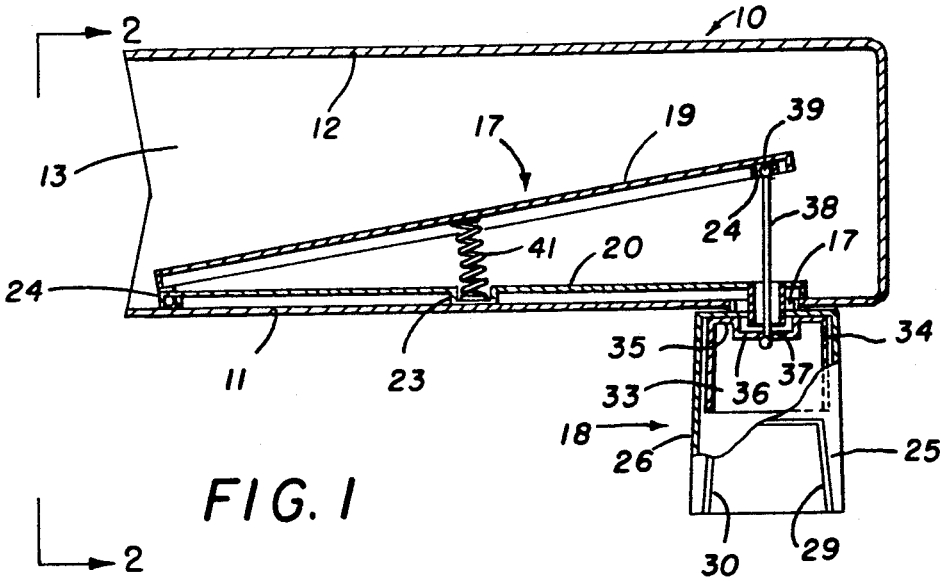
FIG. 1 is a longitudinal vertical sectional view of a receptacle box equipped with the invention at rest.

FIG. 1 of the drawing shows a typical newspaper route tube type delivery box used for daily newspaper delivery. The newspaper box has a generally elongated rectangular configuration having a bottom 11, a top 12, an oppositely disposed spaced side walls 13 and 14 extending therebetween. An end wall 15 completes the typical box configuration having an open end for access thereto. This type of box typically has a number of openings in the bottom for mounting purposes and the like and an example of same is denoted by the aperture best seen in FIGS. 1 and 3 of the drawings at 17.

Figure 2:
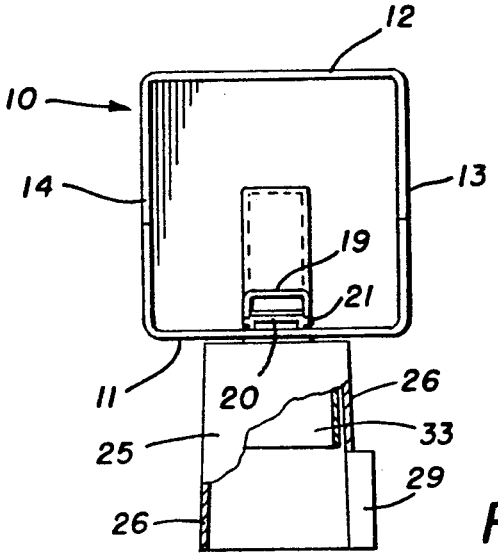
FIG. 2 is an end plan view on lines 2–2 of FIG. 1.

The delivery box signal device of the invention has an internal paper engagement portion 17 and an external signal portion 18. The internal portion 17 is comprised of a pair of elongated inverted cross-sectional U-shaped channel configurations 19 and 20. The channel configuration 20 has a pair of oppositely disposed recessed pivot pins 21 formed on one end and a hollow mounting lug 22 inwardly of said other end. A spring seat 23 is formed within the channel configuration 20 approximately mid-way between said respective pivot pins 21 and mounting lug 22. The mounting lug 22 extends outwardly from and between said channel configuration through said aperture at 17 in said bottom 11 as best seen in FIGS. 1 and 2 of the drawings.

Figure 3:
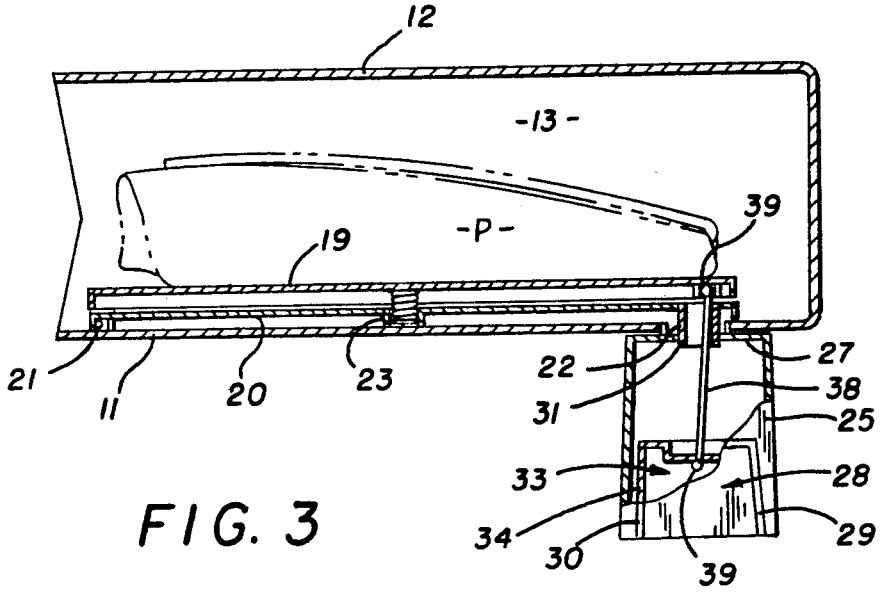
FIG. 3 is a longitudinal vertical cross-sectional view of the receptacle box in FIG. 1 shown activated.
Figure 4:
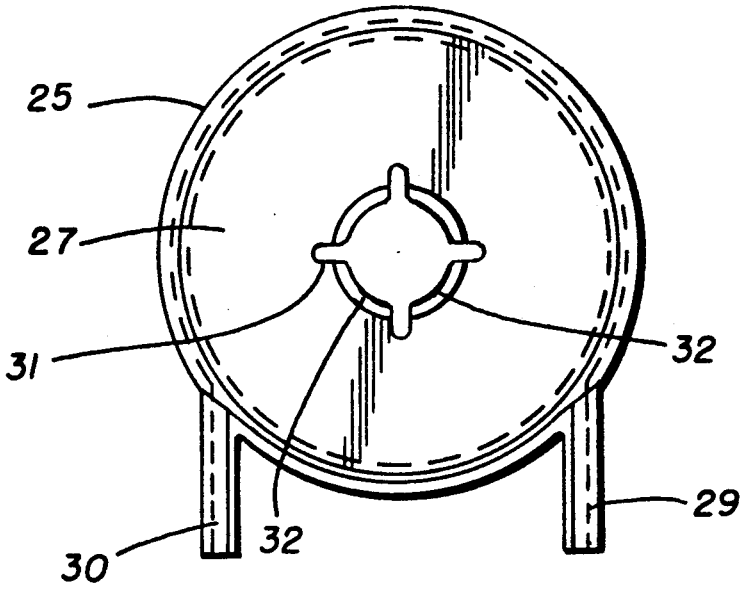
FIG. 4 is an enlarged top plan view of the signal housing of the device.

The channel configuration 19 has a pair of spaced apertured tabs 24 extending downwardly from one end aligned for registration with said respective pivot pins 21 as seen in FIGS. 3 and 4 of the drawings. A recessed control rod aperture at 24 is formed in said channel configuration 19 inwardly of its free end and in vertical alignment with said hollow mounting lug 22 when assembled as shown in FIGS. 1, 2 and 3 of the drawings.

A signal bell housing 25 can be seen having a continuous annular side wall 26 with an integral apertured top 27. A viewing port 28 is formed within the side wall 26 having spaced vertically ascending flanges 29 and 30 defining the viewing port's opening and acting to restrict the effective viewing angle which is defined therebetween as illustrated by the viewing port 28.

Figure 5:
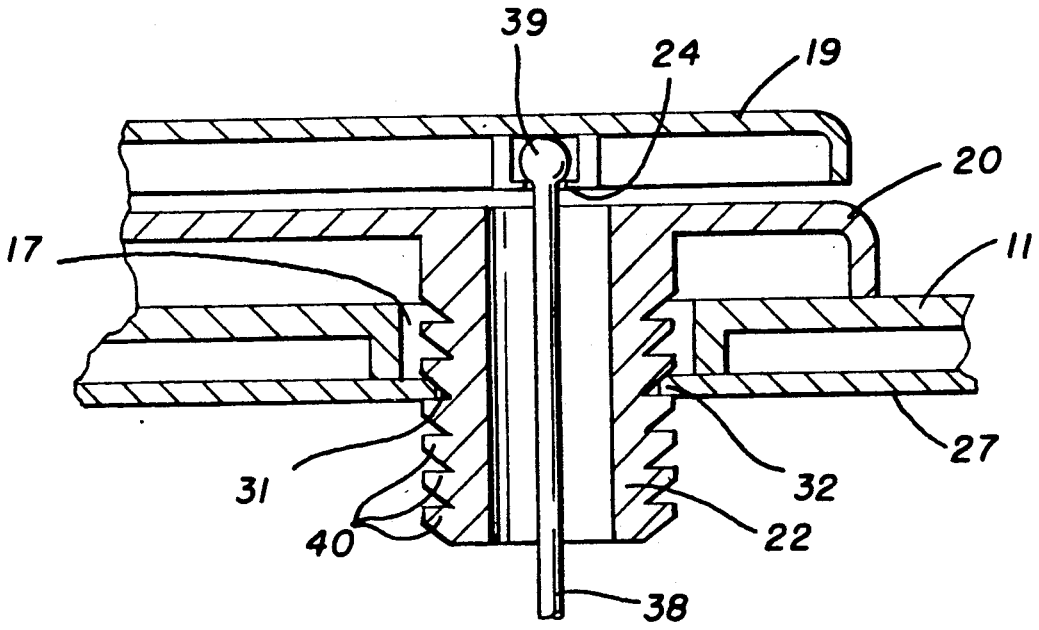
FIG. 5 is an enlarged partial cross-sectional view of a mounting lug used to secure the device within the box as well as position the signaling housing therebelow.

The top 27, best seen in FIG. 5 of the drawings, is apertured at 31 forming multiple oppositely disposed spaced pairs of arcuate resilient attachment flanges 32.

A single bell 33 is movably positioned within the housing 25 and has a continuous annular side wall 34 and an integral top 35. A recessed area 36 is centrally located on said top 35 with an aperture therein at 37. A connecting rod 38 having oppositely disposed enlarged end portions 39 interconnects said channel configuration 19 and said signal bell 33 as best seen in FIG. 1 and 2 of the drawings.

In operation, the interior portion 17 is secured within the deliver box 10 by inserting the lug 22 through the aperture at 17 in the box bottom 11. The signal housing 25 is frictionally fit onto the lug 22 which has a plurality of vertically spaced annular non-connected flights 40. The resilient flanges 32 defining the aperture at 17 in the housing top 27 are selectively engageable on said respective flights 40 securing both the channel configuration 20 and the bell housing 25 to the bottom 11 of the delivery box 10.

The signal bell 33 is positioned within the housing 25 and is secured to the connecting rod 38 extending downwardly through said apertured lug 22 as hereinbefore described.

A spring 41 extends from said seat 23 urging said U-shaped channel configurations 19 and 20 apart for operable position as seen in FIG. 1 of the drawings. The signal bell 33 is drawn up against the top 27 of the housing 25 and above the viewing port 28. Upon activation by a paper P or the like, the U-shaped channel configuration 19 pivots downwardly repositioning said signal bell 33 into the viewing position through the viewing port 28 as seen in FIG. 3 of the drawings.

The signal housing 25 can be rotated a full 360 degrees on the mounting lug 22 so as to selectively aim the viewing port 28 as desired. The vertical flanges 29 and 30 help define the viewing angle of the signal bell 33 preventing casual observation and thus detection of the delivery status available within the viewing port 28.

It will be evident from the above description that the connecting rod 28 will freely pivot on its ends 39 within the apertures at 24 and 37 so that the angular inclination imparted to the rod 38 during activation can be accommodated.

It will thus be seen that a new and novel delivery box signal system has been illustrated and described and it will be apparent to those skilled in the art that various changes and modifications may be made therein without departing from the spirit of the invention.

I claim:

1. A delivery box signal device comprising in combination a pair of elongated channel configurations pivotally secured to one another within a delivery box, a mounting lug extending from one of said channel configuration and said delivery box, an adjustable signal housing rotatably secured on said lug below said delivery box, a signal bell movably positioned within said housing, means for selectively viewing said signal bell within said housing, means for interconnecting said signal bell and one of said elongated channel configurations, a resilient element interengaging said elongated channel configurations.

2. The delivery box signal device of claim 1 wherein said means for selectively viewing said signal bell within said signal housing comprises a viewing port and spaced oppositely disposed vertically ascending flanges on either side of said port.

3. The delivery box signal device of claim 1 wherein said means for interconnecting said signal bell and one of said channels comprises an elongated rod pivotally secured to said channel and said signal bell.

4. The delivery box signal device of claim 1 wherein said mounting lug is hollow and has a plurality of vertically spaced annular flights thereon.

5. The delivery box signal device of claim 2 wherein said signal bell is movably positioned within said housing from a first position above said view port at rest to a second position adjacent said view port upon activation of said interconnected channel member.

6. The delivery box signal device of claim 1 wherein said signal bell housing has an apertured top defined by multiple oppositely disposed spaced pairs of arcuate resilient flanges selectively engageable on said mounting lug.

* * * * *